US008113357B2

(12) United States Patent
Johnson et al.

(10) Patent No.: US 8,113,357 B2
(45) Date of Patent: Feb. 14, 2012

(54) SCREENING MODULE

(75) Inventors: Ronald Leslie Johnson, Warners Bay (AU); Peter Martin Olsen, Roronto (AU); Warren Anthony Spinks, Warners Bay (AU)

(73) Assignee: Ludowici Australia Pty. Ltd., Brisbane (AU)

( * ) Notice: Subject to any disclaimer, the term of this patent is extended or adjusted under 35 U.S.C. 154(b) by 987 days.

(21) Appl. No.: 11/622,897

(22) Filed: Jan. 12, 2007

(65) Prior Publication Data

US 2007/0175802 A1 Aug. 2, 2007

(30) Foreign Application Priority Data

Jan. 13, 2006 (AU) ..... 2006900170

(51) Int. Cl.
*B07B 1/49* (2006.01)

(52) U.S. Cl. ..... 209/397; 209/405

(58) Field of Classification Search ..... 209/392, 209/397, 400, 401, 405; 210/498
See application file for complete search history.

(56) References Cited

U.S. PATENT DOCUMENTS

| | | | | |
|---|---|---|---|---|
| 2,870,910 | A * | 1/1959 | Welmer | 209/396 |
| 4,563,270 | A * | 1/1986 | Wolff | 209/379 |
| 4,661,245 | A * | 4/1987 | Rutherford et al. | 209/399 |
| 4,674,251 | A * | 6/1987 | Wolff | 52/309.15 |
| 4,832,834 | A * | 5/1989 | Baird, Jr. | 209/397 |
| 5,085,324 | A * | 2/1992 | Dehlen | 209/399 |
| 5,462,175 | A * | 10/1995 | Bokor | 209/399 |
| 7,090,083 | B2 * | 8/2006 | Russell et al. | 209/405 |
| 7,303,079 | B2 * | 12/2007 | Reid-Robertson et al. | 209/405 |

FOREIGN PATENT DOCUMENTS

EP 51180 A2 * 5/1982

* cited by examiner

*Primary Examiner* — Joseph C Rodriguez
*Assistant Examiner* — Kalyanavenkateshware Kumar
(74) *Attorney, Agent, or Firm* — Wong, Cabello, Lutsch, Rutherford & Brucculeri, L.L.P.

(57) ABSTRACT

A screening module 10 comprises a frame component 12 to be secured to an underlying screen deck, in use. A screening panel 14 is carried by the frame component 12. The screening panel 14 comprises an operatively upper screening surface 16 and a support structure 18 underlying the screening surface 16 with a plurality of spaced protrusions 20 being supported by and standing proud of the support structure 18. Operatively upper ends of the protrusions 20 lie substantially in a plane of the screening surface 16 and the protrusions 20 define a plurality of screening apertures 22 in the screening surface 16.

17 Claims, 9 Drawing Sheets

SCREENING MODULE

CROSS-REFERENCE TO RELATED APPLICATIONS

The present application claims priority from Australian Provisional Patent Application No 2006900170 filed on 13 Jan. 2006, the contents of which are incorporated herein by reference.

FIELD

This invention relates generally to the screening of particulate materials and, more particularly, to a screening module and to a screening assembly including such a module.

BACKGROUND

In the screening of particulate materials, such as ores, using screening modules there is a trade off between flexibility of a screening panel of the screening module, screening accuracy and open area of the screening module. There is a desire to have the screening panel reasonably flexible to inhibit blinding or pegging of screening apertures of the screening panel. However, if the screening panel is too flexible, there is a risk that oversized ore particles may pass through the apertures. This can have adverse consequences downstream of a screen deck comprising a plurality of the screening modules and may also give rise to penalties.

There is always the desire to have as great an open area as possible to allow the maximum throughput through the screen deck. The open area is generally understood to be the percentage of a surface of the screening panel of the module that is constituted by apertures. Once again, if there is too high a percentage of open area, i.e. a large percentage of the panel is constituted by apertures, there is a risk that the panel will be too flexible and oversized ore particles may pass through the apertures.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

According to the invention there is provided a screening module which comprises a frame component to be secured to an underlying screen deck, in use; and a screening panel carried by the frame component, the screening panel comprising an operatively upper screening surface and a support structure underlying the screening surface, with a plurality of spaced protrusions being supported by and standing proud of the support structure, operatively upper ends of the protrusions lying substantially in a plane of the screening surface and the protrusions defining a plurality of screening apertures in the screening surface.

The support structure may comprise a plurality of cross members. In one embodiment, the cross members may be arranged in a grid or lattice of intersecting cross members. The protrusions may be arranged on the cross members where the cross members intersect. In another embodiment, the cross members may be arranged in spaced parallel relationship. The cross members may extend in an in-flow direction of the module. In this embodiment, the protrusions may be arranged at spaced intervals on the cross members. The protrusions of adjacent cross members may be aligned with each other or, instead, the protrusions of adjacent cross members may be staggered with respect to each other.

If desired, each of at least certain of the cross members may be convex, or bowed, when viewed from a side of the cross member, to provide increasing stiffness towards a central region of the cross member.

Each protrusion may be in the form of a flat topped projection extending from the grid structure. Sides of each projection may taper inwardly from the top of the projection to a mounting position of the projection on the support structure. It will be appreciated that such tapering assists in inhibiting blinding of the screening apertures. It will further be appreciated that the support structure defines a plurality of openings, the openings underlying the screening apertures. However due to the tapered nature of the projections and the cross-sectional dimensions of the cross members, the openings are larger than the apertures. Thus, material passing through the apertures should pass with ease through the openings of the support structure.

The projections may have any suitable outline in plan. Thus, the projections may be rectangular (including square) in plan view. The projections may be arranged diagonally on their associated cross members. Instead, to increase the open area of the screening module further, the projections may be cruciform in plan view. The projections may be arranged on their associated cross members with arms of the cross-shaped projections extending diagonally relative to the cross members when viewed in plan.

The frame component and the screening panel may be integrally formed as a one-piece unit. The unit may be moulded from a suitable synthetic plastics material. The material may be polyurethane. At least the frame component may carry reinforcing to impart rigidity to the unit.

Instead, the frame component and the screening panel may be formed as two separate elements, the screening panel being removably attached to the frame component.

The module may be rectangular. At least the shorter sides of the module may carry mounting formations for securing the module to an underlying screen deck. The mounting formations may be clips carried on the shorter sides of the module, the clips engaging retention rails on the screen deck. Instead of the clips, the mounting formations of the screening module may be receiving formations in each of which a part of a retaining member, as described in International Patent Application No. PCT/AU2005/001376 entitled "A screening module retaining member" dated 9 Sep. 2005, or any modification thereof, is received.

The screening apertures may be arranged in a plurality of aperture arrays. Each aperture array may be delineated by a skirt portion underlying the screening surface. Each skirt portion may bound the support structure associated with that aperture array.

The invention extends also to a screening assembly including a screening module as described above.

DETAILED DESCRIPTION OF EXEMPLARY EMBODIMENTS

Figure 1:
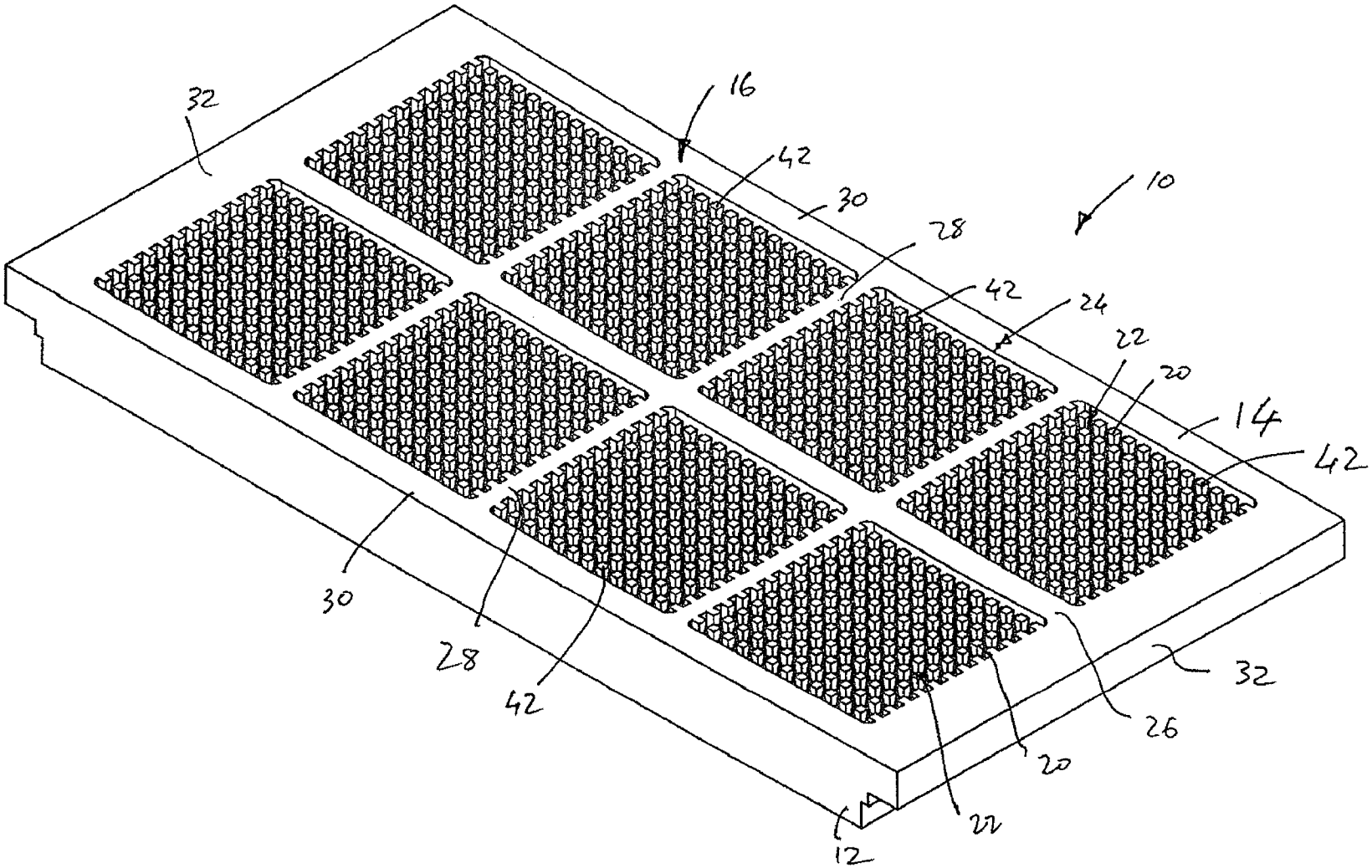
FIG. 1 shows a three dimensional view, from above, of a screening module, in accordance with a first embodiment of the invention.
Figure 2:
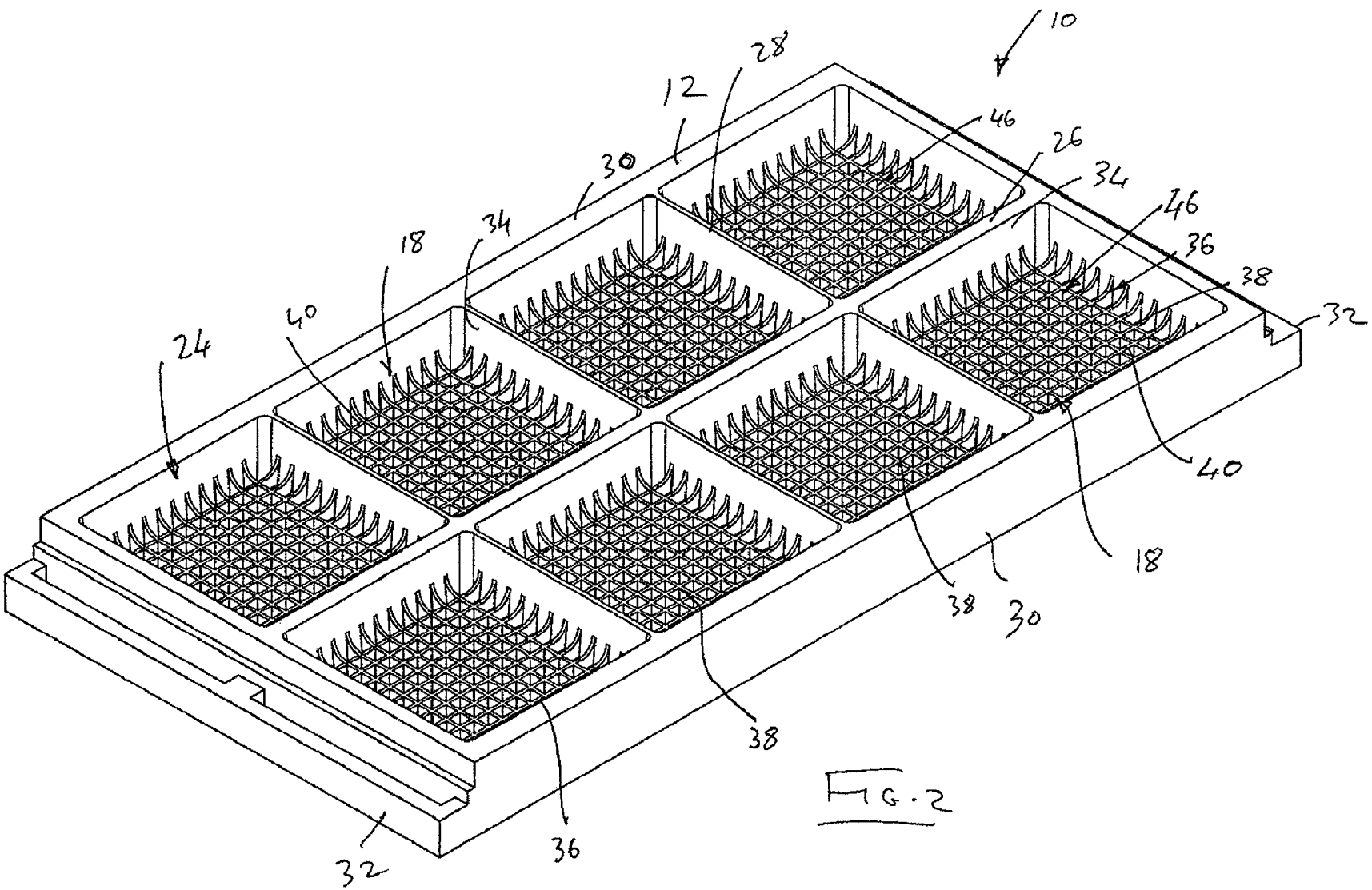
FIG. 2 shows a three dimensional view, from below, of the screening module of FIG. 1.
Figures 3, 4, 5, 6, 7, 8:
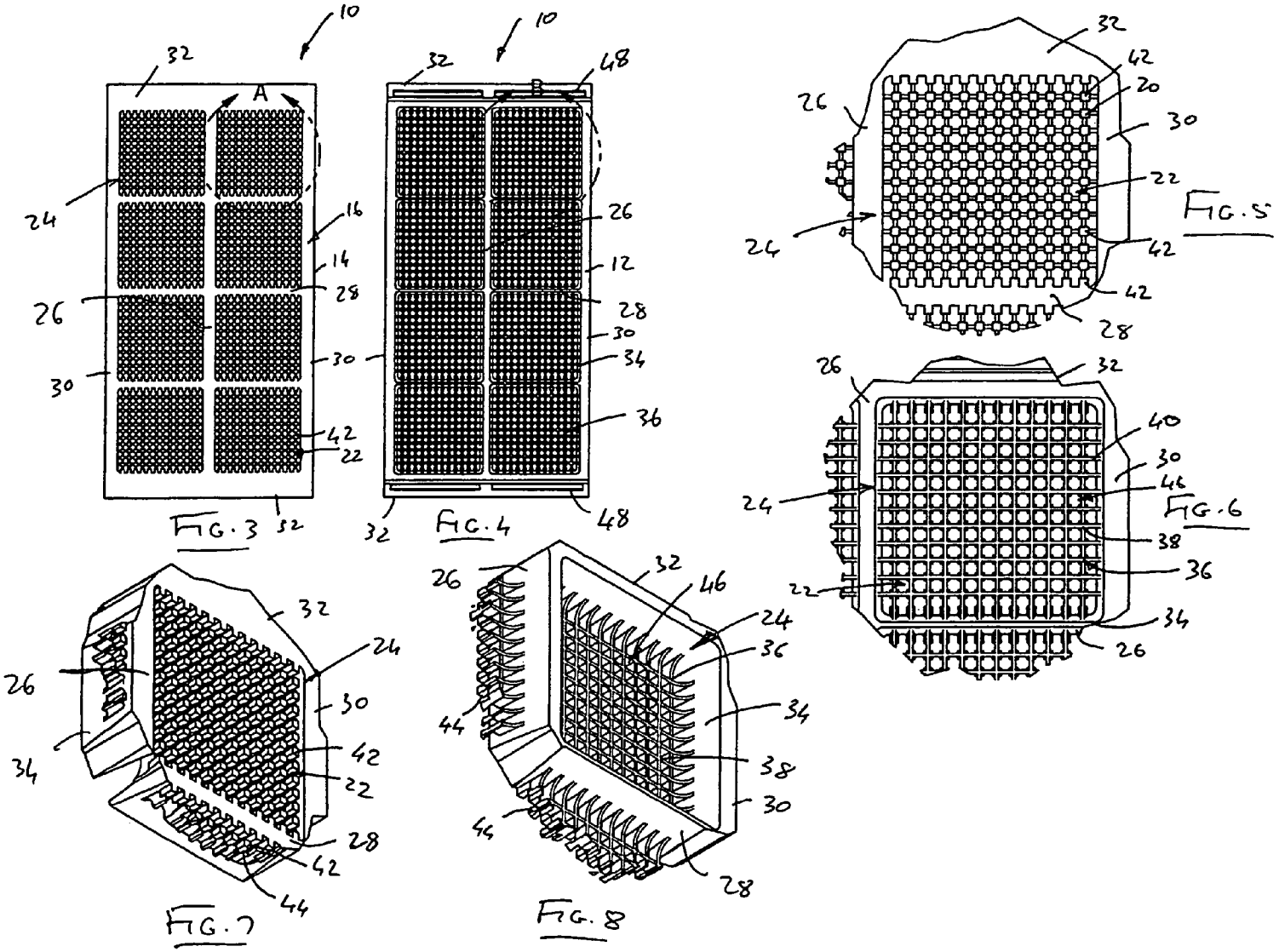
FIG. 3 shows a plan view of the screening module of FIG. 1.
FIG. 4 shows a bottom view of the screening module of FIG. 1.
FIG. 5 shows, on an enlarged scale, a plan view of the detail "A" in FIG. 3 of the drawings.
FIG. 6 shows, on an enlarged scale, a bottom view of the detail "B" in FIG. 4 of the drawings.
FIG. 7 shows, on an enlarged scale, a three dimensional front view of the detail "A" in FIG. 3 of the drawings.
FIG. 8 shows, on an enlarged scale, a three dimensional rear view of the detail "B" in FIG. 4 of the drawings.
Figure 9:
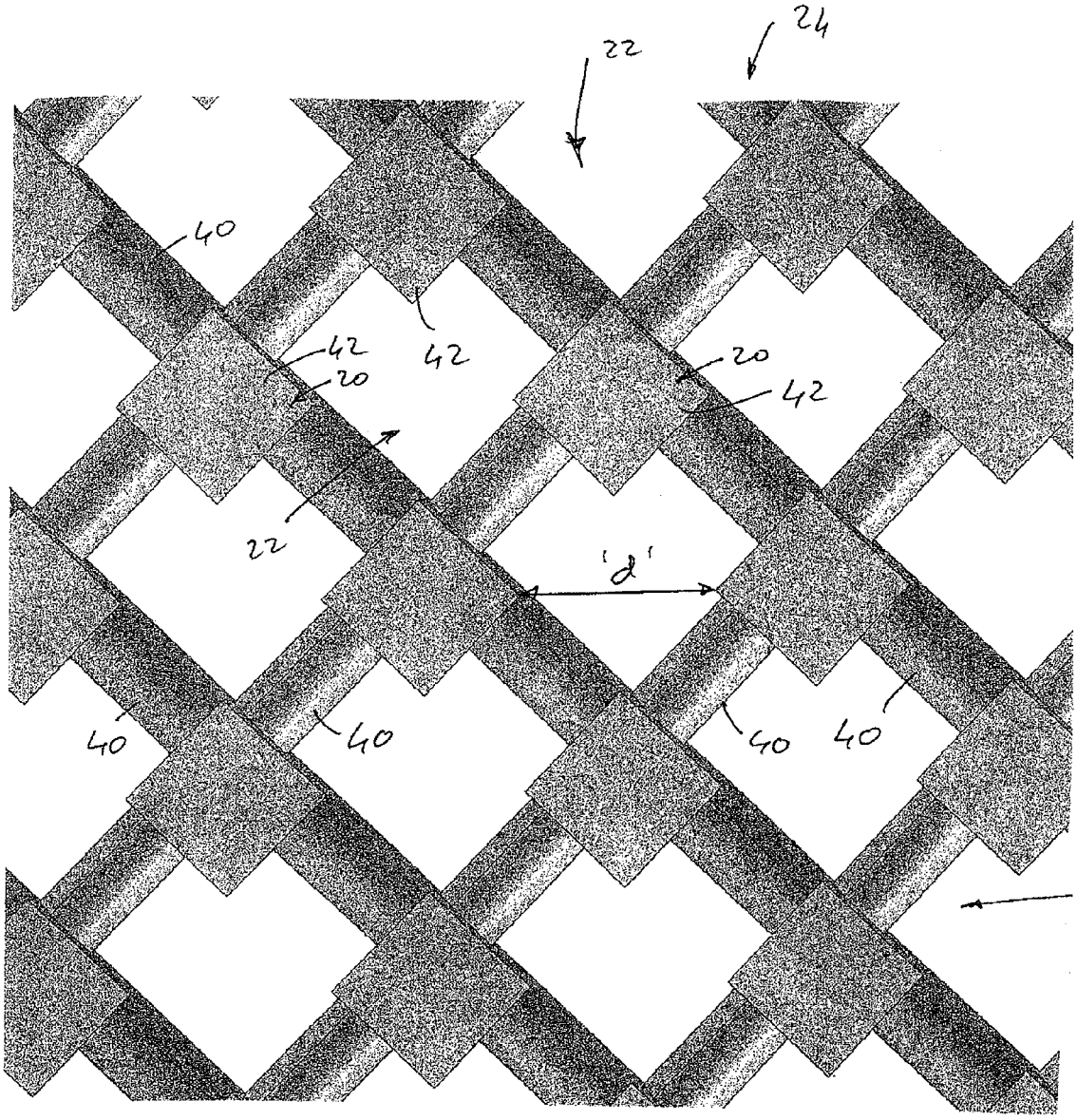
FIG. 9 shows, on a substantially enlarged scale, a plan view of a part of the screening module of FIG. 1.

In FIG. 1 to 9 of the drawings, reference numeral 10 generally designates a screening module, in accordance with a first embodiment of the invention. The module 10 comprises a frame component 12 and a screening panel 14 carried by the frame component 12. In this embodiment, the frame component 12 and the screening panel 14 are formed integrally as a one-piece unit.

The module 10 is a one-piece moulding of a suitable synthetic plastics material, more particularly, a polyurethane material. Typically, the polyurethane material has a Shore Hardness in the range from about 85 to 93 depending on the application of the module 10.

It will, however, be appreciated that, instead, the screening panel 14 could either be moulded separately from the frame component 12 and adhered to the frame component 12. Instead, the screening panel 14 could be releasably secured to the frame component 12 to be replaceable separately from the frame component 12. Thus, in the embodiment shown in FIGS. 10-14 of the drawings, the screening panel 14 defines slots 15 in the underside of the screening panel 14. The slots 15 receive clips (not shown) of the underlying frame component 12 so that the screening panel 14 is able to be removed from the frame component 12 while the frame component 12 is secured to an underlying screen deck.

The screening panel 14 defines a screening surface 16. A support structure 18 (FIG. 2) is arranged operatively below the screening surface 16. The support structure 18 supports a plurality of protrusions 20. The protrusions 20 project upwardly from the support structure 18 terminating in a plane defined by the screening surface 16 of the screening panel 14.

The protrusions 20 define, between them, a plurality of screening apertures 22. As shown most clearly in FIG. 9 of the drawings, each screening aperture 22 has an effective screening size governed by the dimension 'd'.

The apertures 22 are arranged in a plurality of discrete aperture arrays 24. In this embodiment, these aperture arrays 24 are formed by a central member 26 of the module 10 and a plurality of lateral members 28 extending at right angles from the central member 26. These members 26, together with sides 30 and 32 of the module 10, effectively define the aperture arrays 24. More particularly, each aperture array 24 comprises a skirt portion 34 (FIG. 2) bounding the relevant aperture array 24. Each skirt portion 34 supports its associated support structure 18.

In this embodiment, each support structure 18 is in the form of a lattice structure or grid 36. The grid 36 comprises a plurality of orthogonally arranged, intersecting cross-members 40 intersecting at points 38. A protrusion 20 is arranged on each intersecting point 38 of the grid 36.

Each protrusion 20 is in the form of a flat topped projection 42 terminating in the plane of the screening surface 16 of the screening panel 14 of the module 10.

Further, each projection 42 has inwardly tapering sides 44 tapering from its top towards it mounting point 38 on the grid 36. These tapering sides 44 inhibit blinding of the apertures 22 (in the case of wet screening of materials) or pegging (in the case of dry screening of materials).

The cross-members 40 of the grid 36 are of narrow cross-section. As a result, openings 46 (shown most clearly in FIG. 2 of the drawings), bounded by the intersecting cross-members 40 and underlying the apertures 22, are substantially larger than the apertures 22. Thus, material passing through the apertures 22 will pass readily through the openings 46 and is unlikely to block the openings 46.

It is also to be noted that some projections 42 are formed integrally with the lateral members 28 or the side members 32, as the case may be.

As illustrated, the screening module 10 is substantially rectangular and the shorter sides 32 carry mounting formations in the form of clips 48 for clipping to retention rails (not shown) of an underlying screen deck (also not shown). Because the aperture arrays 24 are square and, therefore, symmetrical, the screening modules 10 can be arranged either with their shorter sides parallel to the direction of flow of material over the screen deck or at right angles to the direction of flow of material over the screen deck.

Figure 10:
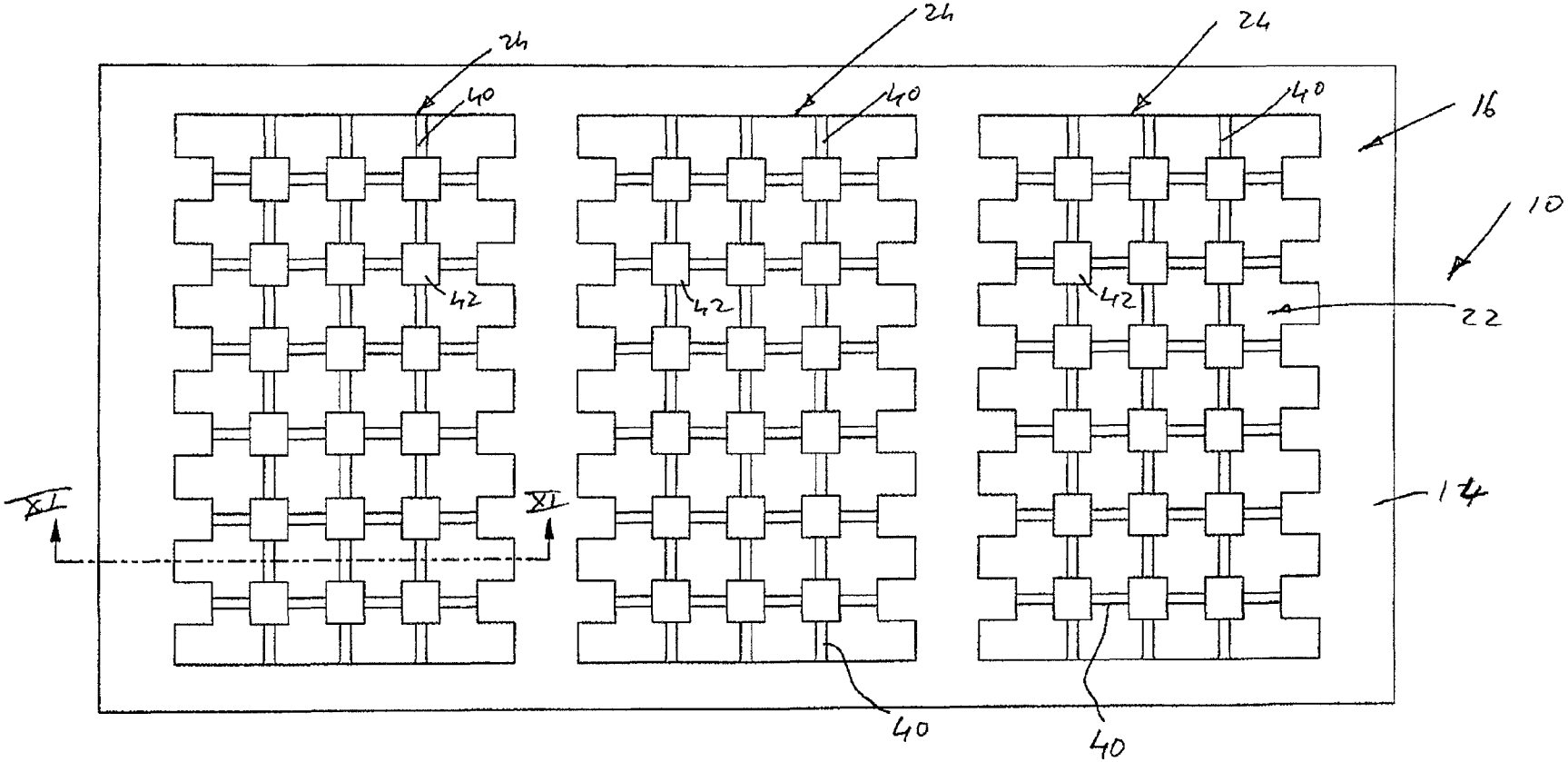
FIG. 10 shows a plan view of a screening panel of a screening module, in accordance with a second embodiment of the invention.
Figure 11:
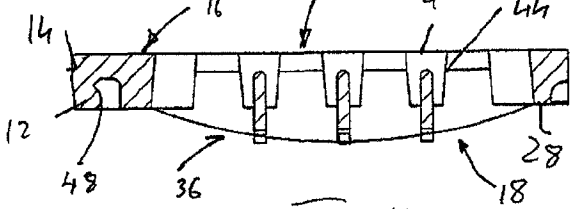
FIG. 11 shows a sectional side view of a part of the screening panel of FIG. 10 taken along line XI-XI in FIG. 10.
Figure 12:
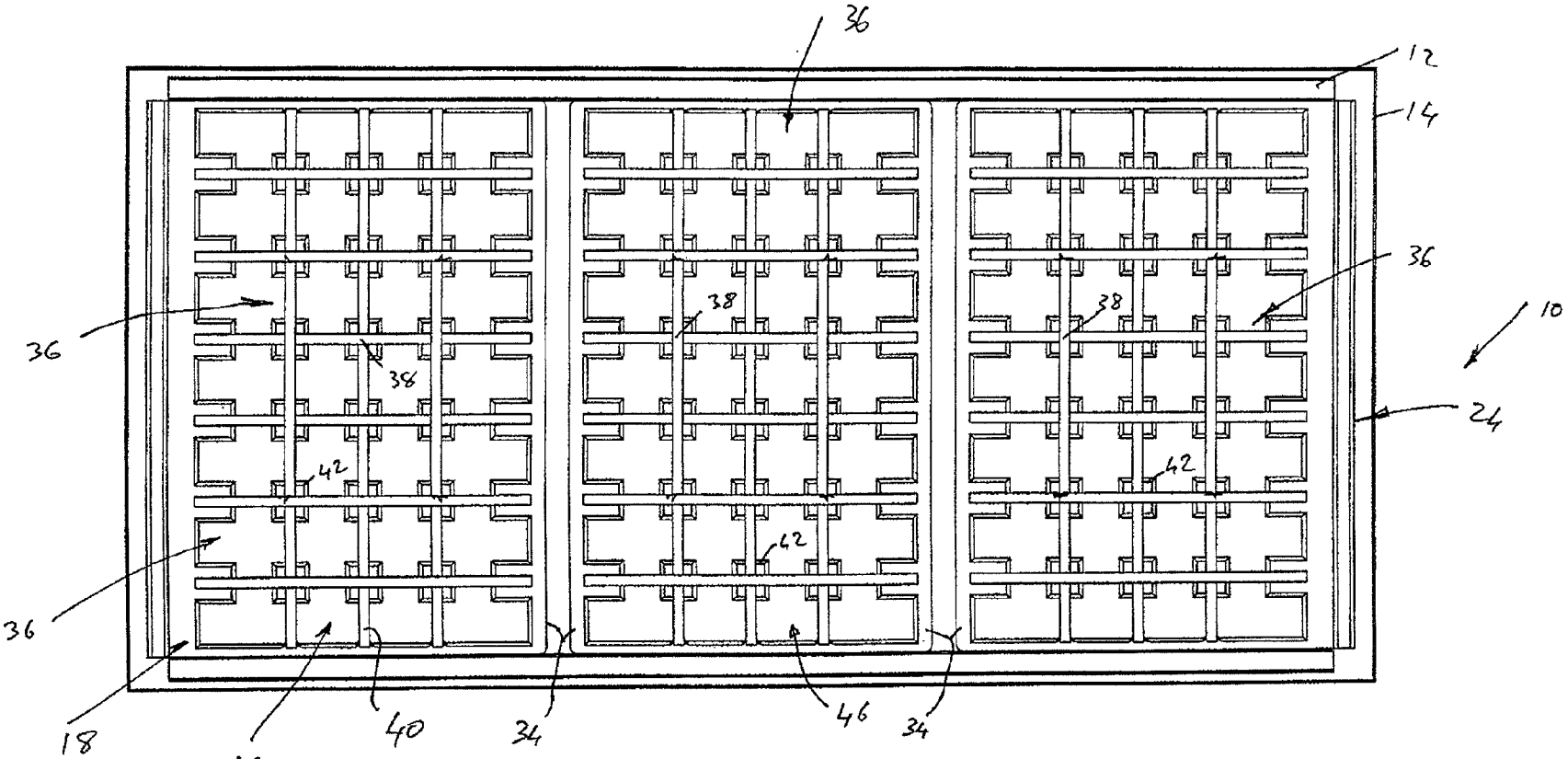
FIG. 12 shows a bottom view of the screening panel of FIG. 10.

Referring now to FIGS. 10 to 12 of the drawings, a screening panel 14 of a second embodiment of a screening module 10 is illustrated. With reference to the previous drawings, like reference numerals refer to like parts, unless otherwise specified.

In this embodiment, the grid 36 of the support structure 18 has a coarser pitch than the grid 36 of the previous embodiment. By "coarser pitch" is meant that the openings 46 defined by the cross members 40 are of larger cross sectional area. Also, there are fewer mounting points for the projections 42. Thus, there are fewer projections 42 than in the previous embodiment. This therefore increases the size of the apertures 22 defined by the projections 42 and results in a screening panel 14 having an even higher open area than the preceding embodiment.

The cross members have a convex, or bowed, lower edge as shown most clearly in FIG. 11 of the drawings in order to increase the stiffness of the cross members 40 and to reduce the flexibility of the cross members 40 and the projections 42.

It is also to be noted that, unlike the embodiment shown in FIGS. 1 to 9 of the drawings, the screening panel 14 illustrated in FIGS. 10 to 12 has three aperture arrays as opposed to the eight aperture array configuration of the preceding embodiment.

Figure 13:
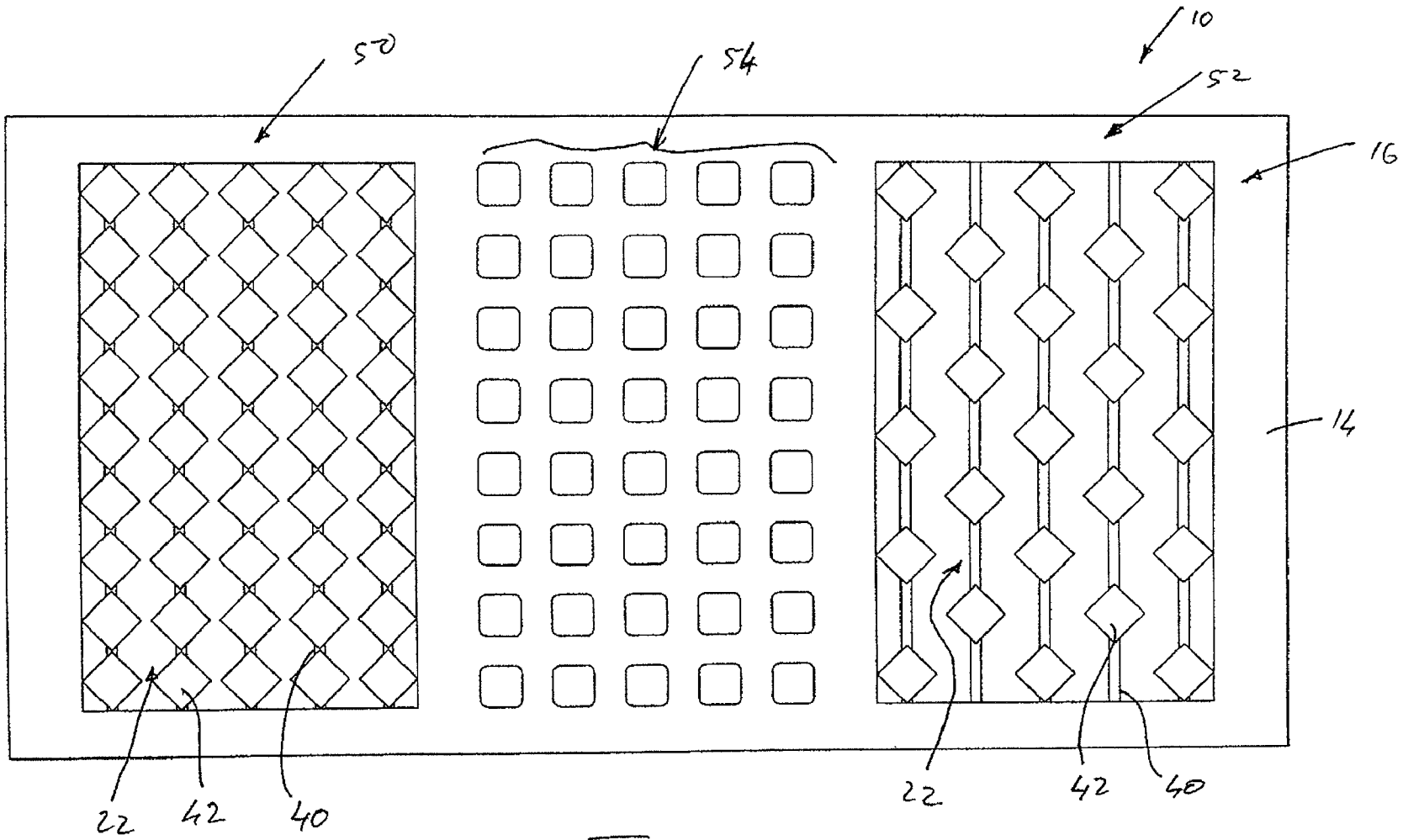
FIG. 13 shows a plan view of a screening panel of a screening module, in accordance with a third embodiment of the invention.
Figure 14:
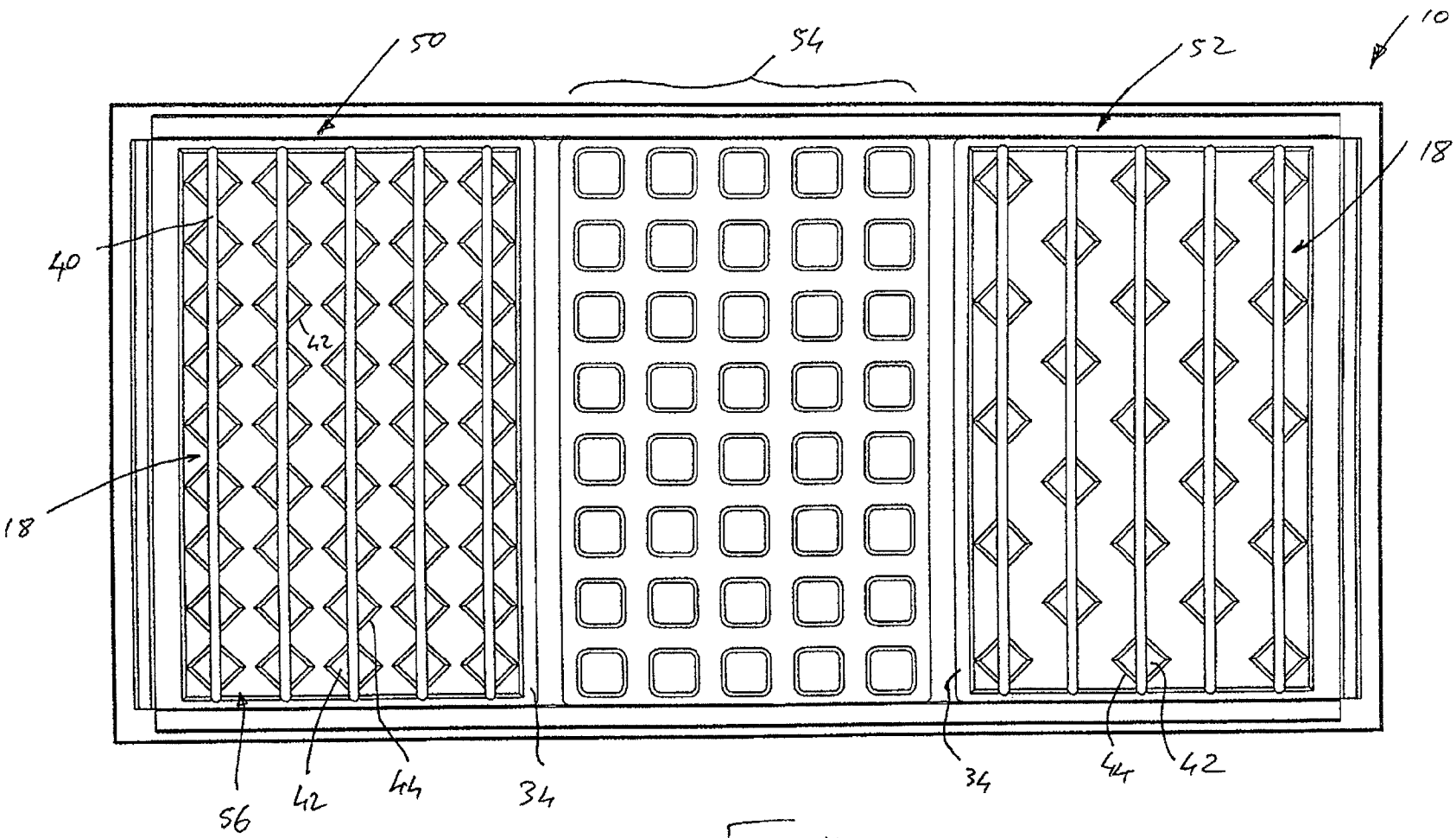
FIG. 14 shows a bottom view of the screening panel of FIG. 13.

Referring to FIGS. 13 and 14 of the drawings, a screening panel 14 of a third embodiment of a screening module 10 is shown. Once again, with reference to the previous drawings, like reference numerals refer to like parts, unless otherwise specified.

In this embodiment, two different configurations of aperture arrays 50 and 52 are provided for illustrative purposes. A central part of the illustrated panel shows a conventional aperture array 54 not using the present invention. The aperture array 54 is illustrated for comparative purposes only and forms no part of the present invention.

In this embodiment of the invention, the support structure 18 comprises a support arrangement of spaced, parallel cross members 40. In other words, intersecting cross members are not included so that slot shaped openings 56 (FIG. 13) are defined between adjacent cross members 40. As in the case of the previous embodiment, the cross members 42 have a convex lower edge to enhance the stiffness of the cross members 40 and to inhibit flexibility of the aperture array 50, 52, as the case may be.

It is to be noted that the cross members 40 are arranged in an in-flow direction in the module 10, i.e. extending parallel to the direction of flow of material over the screening surface 16 of the screening module 10.

The projections 42 are arranged at spaced intervals along each cross member 40. In the case of the aperture array illustrated at 50 in FIGS. 13 and 14 of the drawings, projections of adjacent cross members 40 are aligned with each other. In the case of the aperture array illustrated at 52, the projections 42 on one cross member 40 are staggered with respect to the projections 42 on an adjacent cross member 40, effectively further increasing the open area of a screening module 10 made up of the aperture arrays 52.

In FIGS. 15 to 18 of the drawings, yet a further embodiment of a screening module 10 is illustrated. As in the case of the previous embodiments, like reference numerals refer to like parts unless otherwise specified.

In this embodiment, instead of the projections 42 being square in plan view outline, the projections 42 are cruciform in shape having outwardly projecting arms 58. When viewed in plan, the arms 58 are diagonally arranged relative to the cross members 40 on which the projections are mounted. Thus a pair of projections 42 on one of the cross members 40 and a corresponding pair of projections 42 on an adjacent cross member 40 form rhombus-shaped apertures 22.

Figure 15:
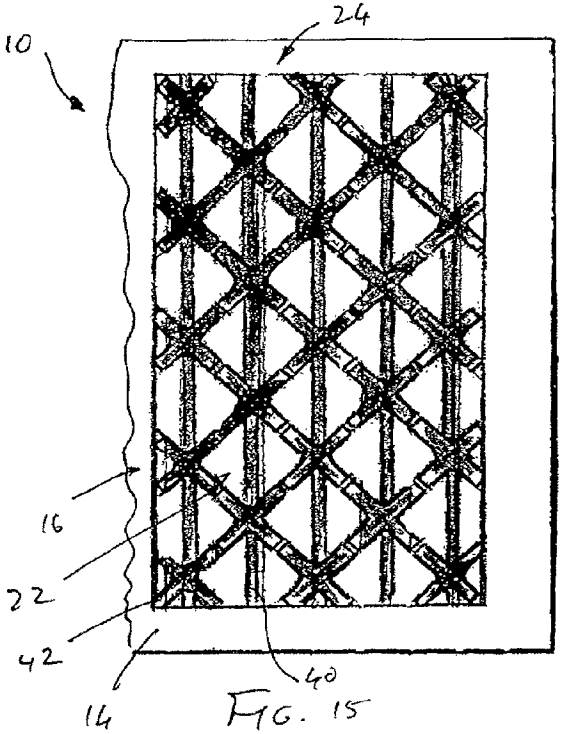
FIG. 15 shows a plan view of a part of a screening module in accordance with a fourth embodiment of the invention.
Figure 18:
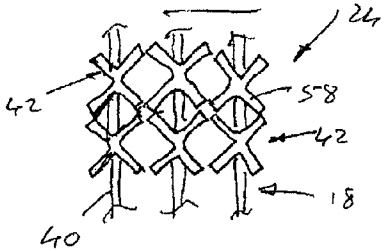
FIG. 18 shows a plan view of a part of a variation of an aperture array of the module of FIG. 15.
Figure 16:
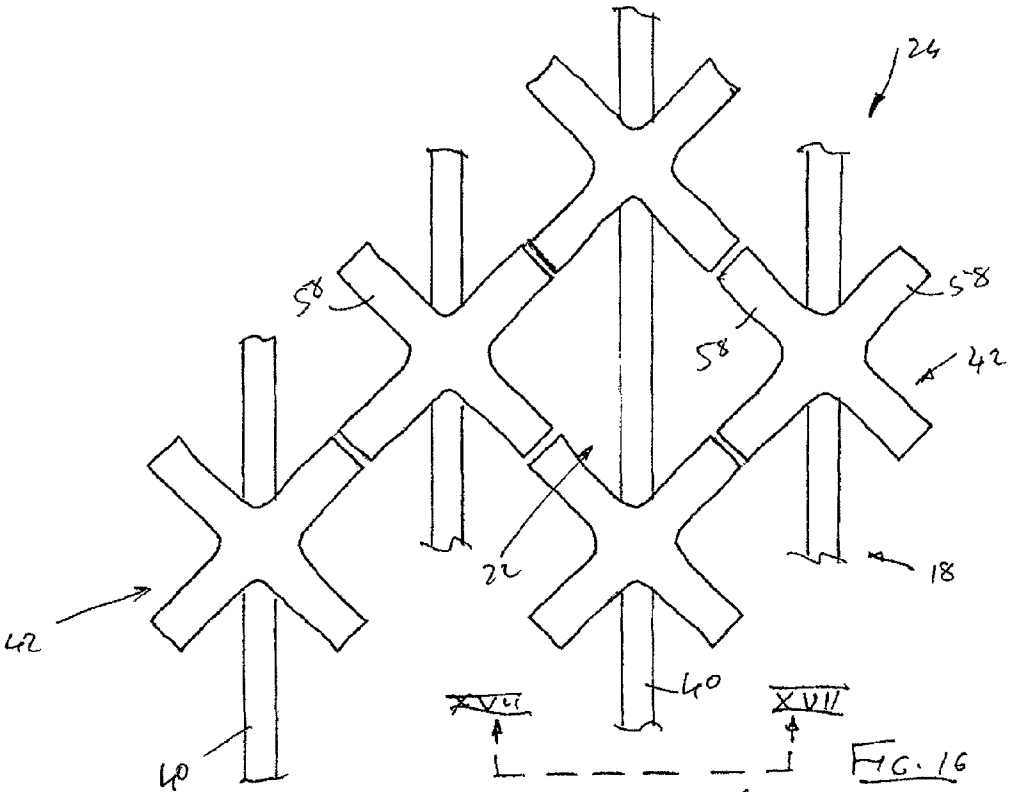
FIG. 16 shows, on an enlarged scale a plan view of a part of an aperture array of the screening module of FIG. 15.
Figure 17:
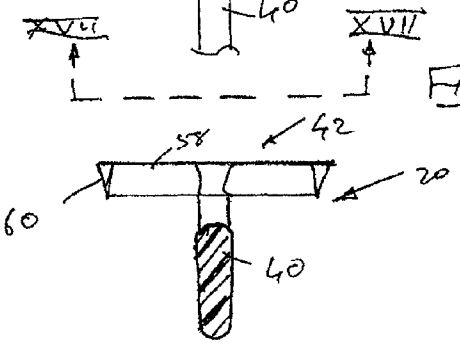
FIG. 17 shows a sectional side view taken along line XVII-XVII in FIG. 16.

In the version shown in FIGS. 15 and 16, the projections 42 on one cross member 40 are staggered with respect to the projections 42 on the adjacent cross member 40 to form large apertures 22. With this configuration, the open area of the module 10 is even greater than in the previous embodiments. In the version shown in FIG. 18, the projections 42 on one cross member 40 are aligned with the projections 42 of the adjacent cross member 40 to reduce the size of the apertures 22.

End faces 60 of the arms 58 of the projections 42 are tapered to inhibit blinding or pegging.

The screening module 10 may, instead of being secured to the underlying rails using clips 48, be attached to the underlying rails using the Applicant's pin system as described in International Patent Application No. PCT/AU200S/01376 entitled "A screening module retaining member" or using one of the systems described in International Patent Application Nos. PCT/AUO2/01463 or PCT/AUO2/01668, both entitled "Screening panel securing system".

In use, as the screen deck vibrates and material passes over the screening modules 10, materials having dimensions smaller than dimension 'd' pass through the apertures 22 and the openings 46 or 56 in the support structure 18. The tapered nature of the projections 42 inhibits blinding or pegging of the apertures 22 and facilitates passage of material through the screening module 10. A further advantage of this configuration of screening module 10 is that the projections 42, themselves, vibrate. In so doing, this assists in dislodging material.

As described above, there is a trade off between flexibility of the screening module 10, screening accuracy and open area of the screening module. Because the projections 42 protrude upwardly from the support structure 18, there is a greater open area defined. It will be appreciated that, because the support structure 18 sits at a level below the screening surface 16 of the module 10, it does not reduce the open area of the screening module 10. This substantially increases the open area of the screening module 10. The Applicant has calculated that, with a screening module in accordance with at least the first embodiment of the invention, due to the absence of cross and in-flow ligaments defining screening apertures, an aperture pattern having an open area exceeding 64% can be obtained. This compares extremely favourably with conventional aperture patterns (such as shown at 54 in FIGS. 13 and 14 of the drawings) having open areas in the range of about 20% for conventional, square apertures and about 30% for slotted apertures. Thus, the screening capacity of the screening module 10 of the invention is substantially enhanced while still providing the necessary screening accuracy and improved flexibility.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A screening module which comprises a frame component to be secured to an underlying screen deck, in use; and a screening panel carried by the frame component, the screening panel comprising an operatively upper screening surface and a support structure underlying the screening surface, with a plurality of spaced protrusions being supported by and standing proud of the support structure, operatively upper ends of the protrusions lying substantially in a plane of the screening surface and the protrusions defining a plurality of screening apertures in the screening surface.

2. The module of claim 1 in which the support structure comprises a plurality of cross members.

3. The module of claim 2 in which the cross members are arranged in a grid of intersecting cross members.

4. The module of claim 3 in which the protrusions are arranged on the cross members where the cross members intersect.

5. The module of claim 2 in which the cross members are arranged in spaced parallel relationship.

6. The module of claim 2 in which the protrusions are arranged at spaced intervals on the cross members.

7. The module of claim 6 in which the protrusions of adjacent cross members are aligned with each other.

8. The module of claim 6 in which the protrusions of adjacent cross members are staggered with respect to each other.

9. The module of claim 2 in which each of at least certain of the cross members are convex, or bowed, when viewed from a side of the cross member, to provide increasing stiffness towards a central region of the cross member.

10. The module of claim 1 in which each protrusion is in the form of a flat topped projection extending from the grid structure.

11. The module of claim 10 in which sides of each projection taper inwardly from the top of the projection to a mounting position of the projection on the support structure.

12. The module of claim 1 in which the frame component and the screening panel are integrally formed as a one-piece unit.

13. The module of claim 1 in which at least the frame component carries reinforcing.

14. The module of claim 1 in which the screening apertures are arranged in a plurality of aperture arrays.

15. The module of claim 14 in which each aperture array is delineated by a skirt portion underlying the screening surface.

16. The module of claim 15 in which each skirt portion bounds the support structure associated with that aperture array.

17. A screening assembly including a screening module as claimed in claim 1.

* * * * *